US005220121A

United States Patent [19]

Kawashima

[11] Patent Number: 5,220,121

[45] Date of Patent: Jun. 15, 1993

[54] MELODY SUPPLEMENT CONTROL APPARATUS

[75] Inventor: Susumu Kawashima, Hamamatsu, Japan

[73] Assignee: Yamaha Corporation, Hamamatsu, Japan

[21] Appl. No.: 530,626

[22] Filed: May 30, 1990

[30] Foreign Application Priority Data

May 31, 1989 [JP] Japan ..... 1-63693[U]

[51] Int. Cl.[5] ..... G10F 1/00; G10H 1/053; G10H 7/00

[52] U.S. Cl. ..... 84/664; 84/650; 84/665; 84/666; 84/708; 84/711; 84/DIG. 4

[58] Field of Search ..... 84/610-614, 84/633-638, 666-669, 650-652, 708-717, DIG. 4, DIG. 22, 615, 626, 665, 631, 664

[56] References Cited

U.S. PATENT DOCUMENTS

| | | | |
|---|---|---|---|
| 3,694,562 | 9/1972 | Hiyma | 84/708 |
| 4,450,742 | 5/1984 | Sugiura | 84/708 |
| 4,499,808 | 2/1985 | Aoki | 84/664 |
| 4,524,668 | 6/1985 | Tomisawa et al. | 84/664 |
| 4,887,505 | 12/1989 | Suzuki | 84/714 |
| 4,896,576 | 6/1990 | Ino | 84/634 |
| 4,903,565 | 2/1990 | Abe | 84/611 |
| 4,905,561 | 3/1990 | Mizuno | 84/DIG. 12 |
| 4,909,116 | 3/1990 | Tanaka et al. | 84/711 |
| 4,991,484 | 2/1991 | Kawashima | 84/636 |

FOREIGN PATENT DOCUMENTS 59-116696 7/1984 Japan .

*Primary Examiner*—William M. Shoop, Jr.
*Assistant Examiner*—Helen Kim
*Attorney, Agent, or Firm*—Spensley Horn Jubas & Lubitz

[57] ABSTRACT

A melody supplement control apparatus is disclosed wherein supplementary tones for melody tones are produced according to predetermined rules, and the degree of the addition of the aforesaid supplementary tones to the aforesaid melody tones is determined based on the pitch of the said supplementary tones.

21 Claims, 4 Drawing Sheets (CONSTRUCTION OF THE PREFERRED EMBODIMENT)

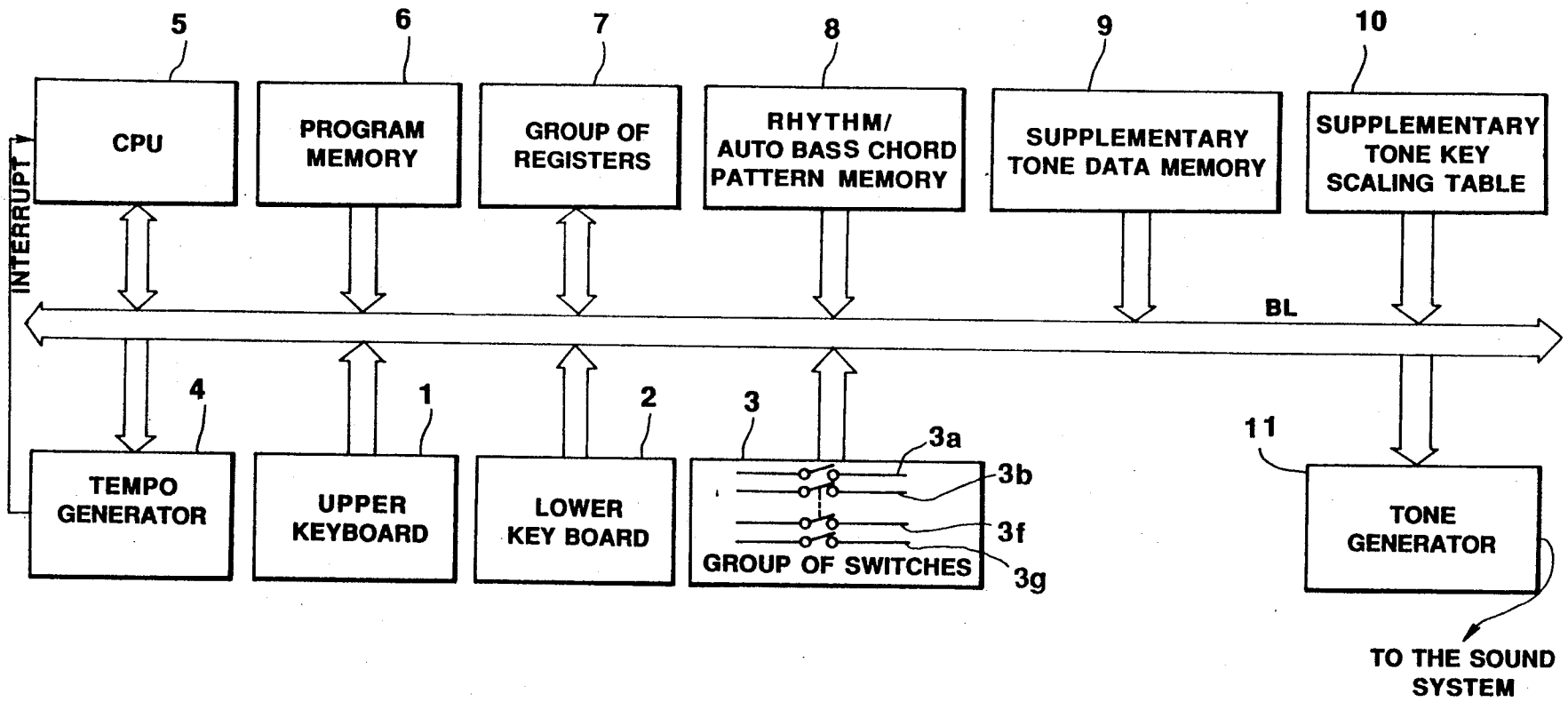
FIG. 1 (CONSTRUCTION OF THE PREFERRED EMBODIMENT)

| | DUET TONE | TRIO TONE |
|---|---|---|
| RHYTHM GROUP A (ROCK,16-BEAT) | 3 DEGREE LOWER | 3 AND 6 DEGREE LOWER |
| RHYTHM GROUP B (WALTZ,SWING,BALLAD) | CLOSEST TONE AMONG CHORD CONSTITUENT NOTES TO A MELODY TONE | CLOSET AND NEXT CLOSEST TONES AMONG CHORD CONSTITUENT NOTES TO A MELODY TONE |

FIG. 2 (SUPPLEMENTARY TONE DATA)

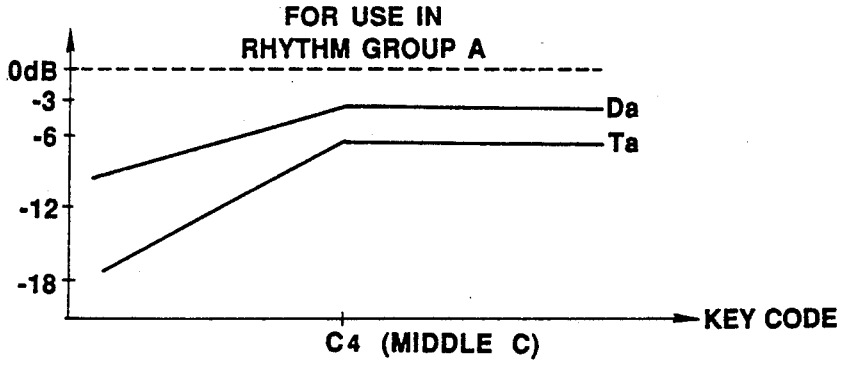

FIG. 3 (CHARACTERISTIC CURVE: VOLUME LEVEL DATA)

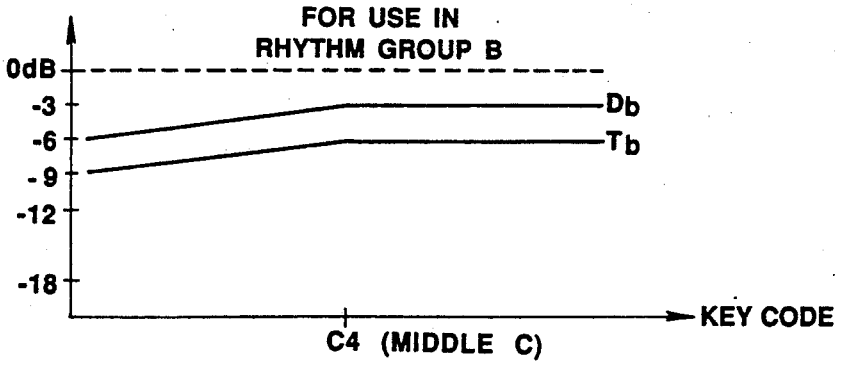

FIG. 4 (CHARACTERISTIC CURVE: VOLUME LEVEL DATA)

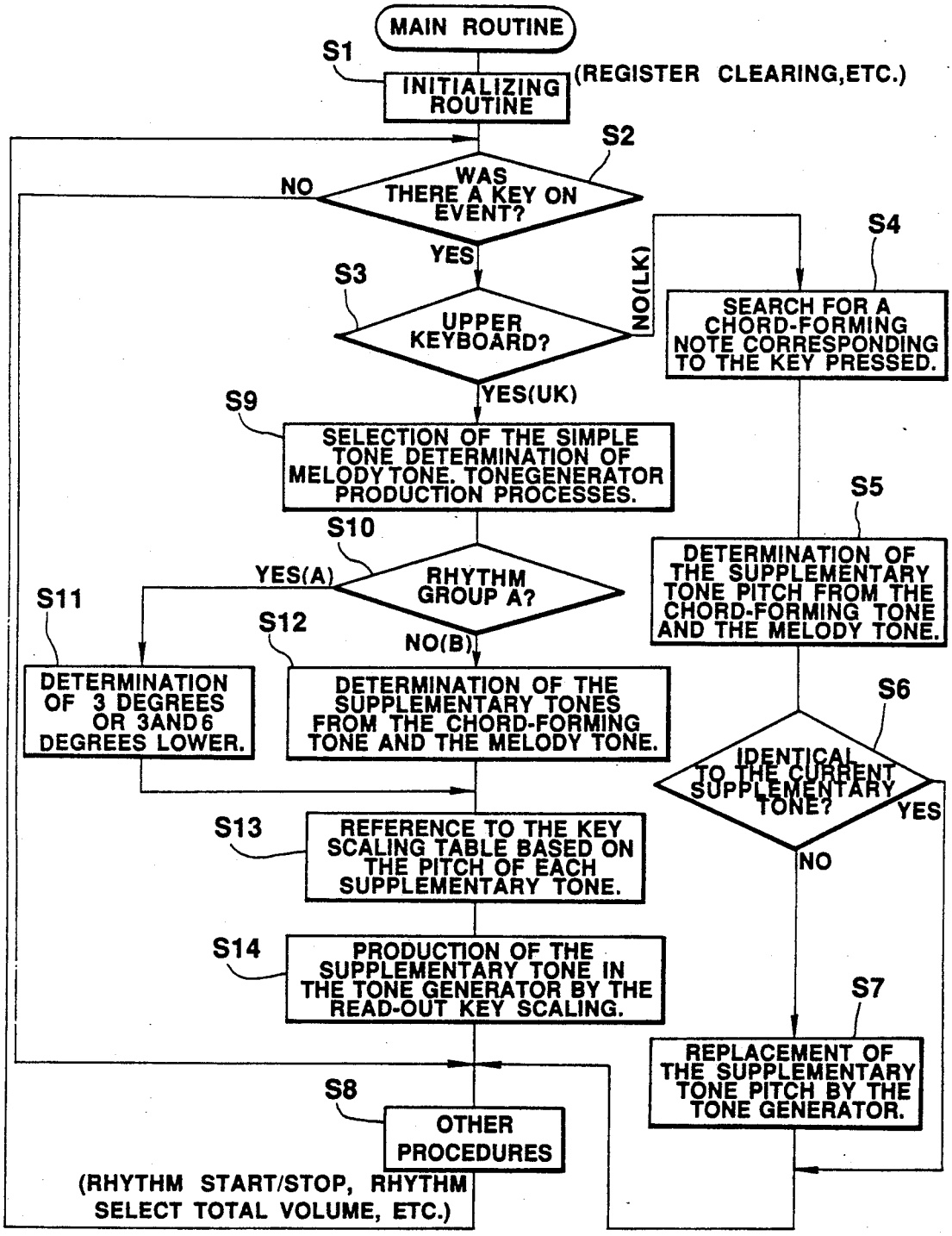
FIG. 5 (MAIN ROUTINE SHOWING OPERATION OF THE PREFERRED EMBODIMENT)

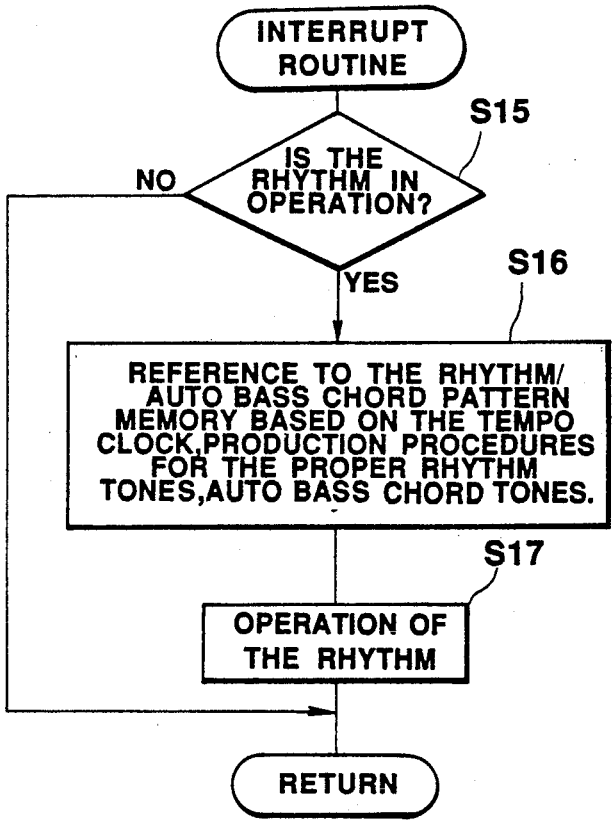
FIG. 6 (INTERRUPT ROUTINE SHOWING THE OPERATION OF THE PREFERRED EMBODIMENT)
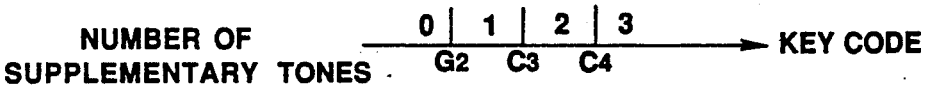
FIG. 7 (EXAMPLE OF APPLICATION OF THE PREFERRED EMBODIMENT)

MELODY SUPPLEMENT CONTROL APPARATUS

BACKGROUND OF THE INVENTION

1. Field of the Invention

The present invention relates to a melody supplement control apparatus for use in electronic musical instruments.

2. Prior Art

As a melodic tone is generated by means of a keyboard, supplementary tones are generated for achieving the effect of playing duet or trio harmonies. The pitch of the supplementing tones is determined by the current type of chord in response to pressing the keys, so that the tones are generated simultaneously with the pressing of the keys.

However, with the conventional technology in the case in which supplementary tones are added to the melody tones in low-pitch ranges, undesirable interference occurs between the supplementary tones and the melody tones in the low-pitch ranges and the tones become unclear.

In order to solve this problem, the applicant presented a method (see the specifications of Japanese Patent Application, First Publication No. 59-116696) to reduce the volume level of the supplementary tones with respect to the melody tones (for example, by three or six dB: decibel). However, this method was not able to reduce the interference between the melody tones and the supplementary tones in low-pitch ranges.

SUMMARY OF THE INVENTION

This device solves the problems mentioned above; its purpose is to supply a melody supplement control apparatus which reduces the interference of the supplementary tones with the melody tones in low-pitch ranges and therefore enables an improvement in the clarity of the notes.

This device is a melody supplement control apparatus which has the special characteristics of possessing a supplementary tone generation means, which generates the supplementary tones for the melody tones according to predetermined rules, and a supplementary tone control means, which determines the degree of supplementation of the aforesaid melody tones by the aforesaid supplementary tones based on the pitch of the said supplementary tones.

According to the above construction, the degree of supplementation by the supplementary tones to the melody tones is based on the pitch of the supplementary tones. Therefore, by means of the reduction in the degree of supplementation accompanying a reduction in pitch of the supplementary tones, the interference in low-pitch ranges of the supplementary tones with the melody tones is reduced.

In this way, the degree to which supplementary tones are added to a melody tone is determined based on the pitch of the supplementary tones. By means of this, a reduction in the degree of addition of the supplementary tones in low-pitch ranges can be achieved. Accordingly, the interference in low-pitch ranges of the supplementary tones with the melody tones is reduced and the clarity of the tones is improved.

BRIEF DESCRIPTION OF THE DRAWINGS

FIG. 1 is a block diagram showing the first preferred embodiment of this device.

FIG. 2 is for the purpose of explaining the supplementary tone data used in the same first preferred embodiment.

FIGS. 3 and 4 show key scaling tables for the supplementary tones used in the same first preferred embodiment.

FIGS. 5 and 6 are flowcharts for the purpose of explaining the operation of the first preferred embodiment.

FIG. 7 is for the purpose of explaining the second preferred embodiment.

DETAILED DESCRIPTION OF THE PREFERRED EMBODIMENTS

The preferred embodiments of the device will herein be explained with reference to the diagrams.

FIG. 1 is a block diagram showing the case in which a melody supplement control device according to the first preferred embodiment of the device is applied to an electronic piano. Upper keyboard 1 is used in the playing of the melody in an electronic piano; it has the function of outputting the key code, etc., for a key that has been pressed. Lower keyboard 2 is used in the playing of the chords in an electronic piano; in the same way as the aforesaid upper keyboard, it has the function of outputting the key code, etc., for a key that has been pressed. The group of switches 3 is used to set the various types of functions in an electronic piano. Among this group of switches 3, the rhythm pattern switches 3*a*–3*e* (switches 3*c*–3*e* are omitted in the diagram), the duet tone switch 3*f*, and the trio tone switch 3*g* are provided. The rhythm pattern switches 3*a*–3*e* set the rock, 16-beat, waltz, swing, and ballad functions. Furthermore, the duet tone switch 3*f* sets the duet tones. The trio tone switch 3*g* sets the trio tones. Tempo generator 4 generates a time clock (a clock which interrupts the CPU according to that timing which is suited to a certain rhythm pattern) suited to the rhythm pattern switches 3*a*–3*e*. For example, when the rhythm pattern switch 3*a* is in the on (closed) state, a time clock suited to the rock rhythm pattern is generated, and when the rhythm pattern switch 3*b* is in the on state, a time clock suited to the 16-beat rhythm pattern is generated. CPU (Central Processing Unit) 5 governs every part of the apparatus. Program Memory 6 (ROM: Read Only Memory) stores the program of CPU 5, and the group of registers 7 is made up of a number of registers. Among this group of registers 7, a key code register (omitted in the diagram), which temporarily stores the key code which is outputted from upper keyboard 1 or lower keyboard 2, is provided. Rhythm/auto bass chord pattern memory 8 is where the rock, 16-beat, waltz, swing, and ballad rhythm patterns, as well as the auto bass chord are stored. The various types of rhythm pattern and auto bass chord stored in this rhythm/auto bass chord pattern memory 8 are read out by CPU 5 based on the various time clocks. Supplementary tone data memory 9 stores data as to what type of supplementary tones should be added to a melody tone which is played. This supplementary tone data is read out by CPU 5 based on the time clock and the on/off state of the duet tone switch 3*f* and the trio tone switch 3*g*. Diagram 2 shows the supplementary tone data. In this diagram, in the rhythm group A, which consists of the rock and 16-beat rhythms, when a duet tone is set, a supplementary tone is selected which is 3 degrees lower than the melody tone which is played. Furthermore, when trio tones are set, supplementary tones are selected which are 3 and 6 degrees lower, respectively, than the melody tone which is played. In the rhythm group B, which consists of the waltz, swing, and ballad rhythms, when a duet tone is set, the supplementary tone which is closest to the melody tone is selected from among those chord constituent notes. In addition, when trio tones are set, the supplementary tone which is closest to the melody tone and that which is next closest are selected from among those chord constituent notes.

In FIG. 1, the supplementary tone key scaling table 10 is shown. The tone key scaling table 10 stores data used to determine the volume level of the supplementary tone. The supplementary tone data memory 9 stores data used to determine the pitch of the supplementary tone. To explain in further detail, the characteristic curve Da, for use with duet tones, and the characteristic curve Ta, for use with trio tones, which correspond to the rhythm group A shown in FIG. 3, and the characteristic curve Db, for use with duet tones, and the characteristic curve Tb, for use with trio tones, which correspond to the rhythm group B shown in FIG. 4, are stored in this supplementary tone key scaling table 10. Each of these characteristic curves Da, Ta, Db, and Tb determine the volume level of the supplementary tones over the whole scale based on the type of rhythm and the number of harmonious tones; in particular, they are so set that the volume level decreases continually beginning at $C_4$ (middle C). Furthermore, among the characteristic curves Da, Ta, Db, and Tb, the slope of the characteristic curves Da and Ta in the low-pitch range is greater than the slope in characteristic curves Db and Tb. The reason for this is that in the rhythm group A, a tone which is 3 or 6 degrees lower is simply automatically added, and thus in comparison with the rhythm group B, where a supplementary tone is selected which creates a chord, the effect of harmony in the low-pitch range is likely to become undesirable.

In Diagram 1, tone generator 11 is shown; the key data which are created by CPU 5 are inputted through the medium of bus line BL, and based on this the tone generator 11 generates a musical ton signal. The musical tone signal which is outputted from this tone generator 11 is supplied to the outer sound system (omitted in the diagram), and, after being amplified by this outer sound system, is outputted from the speakers (omitted in the diagram) as music.

In the following, the operation of a melody supplement control device with the aforesaid construction will be explained. FIG. 5 is a main routine flowchart showing the operation of CPU 5.

When a power source is connected to the apparatus, the initializing procedure of step S1 is carried out, and all registers of the group of registers 7 are cleared. After this initializing procedure has been completed, step S2 is proceeded to, and a judgment is made as to whether or not a key on event had occurred at any of the keys of upper keyboard (UK) 1 or lower keyboard (LK) 2. When the result of this judgment is "no," in other words, when a key on event has not occurred, step S8 is proceeded to, and the other procedures in the electronic piano, such as rhythm start/stop, rhythm select, total volume, etc., are carried out. In the case of "yes," in other words, when a key on event has occurred, step S3 is proceeded to. When step S3 is proceeded to, the key code from the key which was pressed is set in the key code register. After this, a judgment is carried out as to whether this key is in upper keyboard 1 or not. When the result of this judgment is "no," in other words, if the key is not in upper keyboard 1, step S4 is proceeded to; when the result is "yes," in other words, when the key is in upper keyboard 1, step S9 is proceeded to.

When step S4 is proceeded to, a chord is sought in correspondence with the key code of the key which was pressed. After this, step S5 is proceeded to, and the pitch of the supplementary tone is determined based on the chord which was sought in step S4 and the melody tone, if a melody tone has been previously detected. Following this, when the pitch of the supplementary tone has been determined, step S6 is proceeded to, and a judgment is made as to whether the supplementary tone which was determined and the supplementary tone which is being produced at that moment are identical. When the result of this judgment is "yes," in other words, in the case in which they are identical, nothing occurs and step S8 is proceeded to. If the result is "no," in other words, in the case in which they are not identical, step S7 is proceeded to. In step S7, the pitch of the supplementary tone at the present moment is replaced by a redetermined supplementary tone pitch, and the key data containing this supplementary tone are supplied to tone generator 11. After this, tone production procedures are carried out in tone generator 11, and after the tone is produced, step S8 is proceeded to.

In step S3 mentioned above, when it is judged that the key which was pressed was on upper keyboard 1, and step S9 is proceeded to, the selection of a simple tone is carried out from the key code of the key which was pressed, and a melody tone is determined. After that, the key data which include the melody tone which was determined are supplied to tone generator 11, and after tone production procedures are carried out, the tone is produced. Following this, step 10 is proceeded to. In step 10, a judgment is made, based on the time clock which was outputted by tempo generator 4, as to whether the rhythm pattern which was determined belongs to rhythm group A or not. If the result of this judgment is "yes," in other words, if the rhythm pattern which was determined belongs to group A, step S11 is proceeded to; if the result is "no," in other words, if the rhythm pattern which was determined does not belong to group A, step S12 is proceeded to.

In Step 11, tones which are 3 degrees or 3 and 6 degrees below the melody tone, which was determined in step S9, are determined as the supplementary tones. A determination as to whether a supplementary tone which is 3 degrees lower or two supplementary tones which are 3 and 6 degrees lower are selected is made based on the data which are obtainable, among the supplementary tone data which are stored in supplementary tone data memory 9, from the on/off state of duet tone switch **3*f* and trio tone switch 3*e*. In other words, if the duet tone switch 3*f* is in the on position, a tone 3 degrees lower will be selected as the supplementary tone, while if the trio tone switch 3*g* is in the on position, two tones 3 and 6 degrees lower will be selected as the supplementary tones. After each supplementary tone (in the case of duet tones, one tone; in the case of trio tones, two tones) has been determined, step S13** is proceeded to.

In step S12, the supplementary tone is determined on the basis of the melody tone which was determined in step S9 and the previously detected chord. In this case, as above mentioned, the supplementary tone is determined based on, among the supplementary tone data which are stored in supplementary tone data memory 9, the on/off state of duet tone switch **3*f*** and trio tone switch 3e. In other words, if the duet tone switch 3f is in the on position, the supplementary tone which is closest to the melody tone is selected from among those chord constituent notes, and if the trio tone switch 3g is in the on position, the supplementary tone which is closest to the melody tone and that which is next closest are selected from among those chord constituent notes. Next, after each supplementary tone has been determined, step 13 is proceeded to. When step 13 is proceeded to, the volume level of each supplementary tone is determined based on the pitch of each supplementary tone, which was determined in step S11 or step S12, and with reference to the characteristic curves Da and Ta or Db and Tb of supplementary tone key scaling table 10. In this case, in step S11, the supplementary tone which is 3 degrees lower is determined based on characteristic curve Da, while the supplementary tone which is 6 degrees lower is determined based on characteristic curve Ta.

In step S12, the supplementary tone which is closest to the melody tone is selected from among those chord constituent notes based on characteristic curve Db, and that tone which is next closest is selected based on characteristic curve Tb. After this, when the processes in step S13 have been completed, step 14 is proceeded to. When step 14 is proceeded to, the key data containing the supplementary tone, the volume level of which was determined in step S13, are supplied to tone generator 5, tone production procedures are carried out, and the tone is produced. After the tone production processes of each supplementary tone have been completed, step 8 is proceeded to. The above is the operation of CPU 5 in the main routine.

FIG. 6 is an interrupt routine flowchart showing the operation of CPU 5. This interrupt routine executes when CPU 5 is interrupted by the time clock.

When CPU 5 is interrupted by the time clock, in step S15, a judgment is made as to whether the rhythm is in operation or not. In the case in which the result of this judgment is "yes," in other words, if the rhythm is in operation, step S16 is proceeded to, while if the result is "no," in other words, if the rhythm is not in operation, nothing is carried out.

In step 16, based on the time clock, the rhythm and auto bass chords stored in rhythm/auto bass chord pattern memory 8 are read out and supplied to tone generator 11. After this, the procedures for the production of the rhythm tones or auto bass chord tones which are to be produced are carried out. After these production procedures have been completed, step S17 is proceeded to, and the rhythm tones or auto bass chord tones are produced.

FIG. 7 is for the purpose of explaining the second preferred embodiment of the present device. In this second preferred embodiment, the number of supplementary tones changes corresponding to the tonal range of the supplementary tones, and the clarity of the tones is improved. The basic construction and operational flowcharts of this second preferred embodiment are identical to those of the previous first preferred embodiment; therefore, an explanation or depiction of them in diagrams is omitted here. The differences between this second preferred embodiment and the previous first preferred embodiment are in steps S11, S12, and S13 of the main routine in FIG. 5. In the case of the second preferred embodiment, the largest number of supplementary tones is set at 3 (for example, 3, 6, and 9 degrees lower than the memory tone) based on the lowest pitch of the supplementary tone in step S13; if it is higher than C4, there are three supplementary tones, if it is between C3 and C4, among the three supplementary tones, the tone which is 9 degrees lower, which is the same as the lowest-pitched tone, is eliminated from the supplementary tones, if it is between G2 and C3, the tones which are 6 and 9 degrees lower are eliminated, and furthermore, if it is below G2, no supplementary tone is generated. In this way, to the extent that the lowest pitch of the supplementary tones falls, the number of supplementary tones is decreased, and by means of this the low-pitched supplementary tones do not interfere with the melody tones.

In the aforesaid first and second preferred embodiments, by means of the number of tones which produce harmony and timbre (in a duet, 2, in a trio, 3), the characteristic curves (in rhythm group A, Da and Ta; in rhythm group B, Db and Tb) of supplementary tone key scaling table 10 can be determined at will; therefore, appropriate harmonies can be reproduced from low-pitch ranges to high-pitch ranges.

EXAMPLES OF OTHER APPLICATIONS

In the aforesaid first preferred embodiment, explanations were given for up to two supplementary tones, but the supplementary tones are not necessarily limited to this number.

Furthermore, in the aforesaid first and second preferred embodiments, the characteristic curves of key scaling table 10 were set as shown in FIGS. 3 and 4, but they are not necessarily so limited. In addition, it is not necessary to use middle C ($C_4$) as a dividing point.

In addition, in the above preferred embodiments, the determination of the supplementary tones was carried out based on the supplementary tone data shown in FIG. 2; however, this determination is not limited to the basis of these supplementary tone data.

What is claimed is:

1. A melody supplement control apparatus comprising:

melody tone generation means for generating a melody tone having a selectable pitch;

supplementary tone generation means for generating a supplementary tone having a pitch which has a predetermined relationship with the pitch of the melody tone; and supplementary tone control means responsive to the supplementary tone generation means for determining a volume level for the supplementary tone based on the pitch of the supplementary tone.

2. A melody supplement control apparatus in accordance with claim 1 wherein the supplementary tone control means decreases the volume level of the supplementary tone as the pitch of the supplementary tone decreases.

3. A melody supplement control apparatus in accordance with claim 1, wherein the supplementary control means decreases the volume level for the supplementary tone, as the pitch of the supplementary tone decreases.

4. A melody supplement control apparatus in accordance with claim 3 including means for selecting one of a plurality of rhythm patterns and wherein the predetermined relationship between the pitch of the supplementary tone and the pitch of the melody tone is determined by the selected rhythm pattern.

5. A melody supplement control apparatus in accordance with claim 3 wherein the supplementary tone generation means is capable of generating a number of supplementary tones and the number of generated supplementary tones is controlled by a user-settable switch.

6. A melody supplement control apparatus in accordance with claims 3 wherein the supplementary tone generation means generates a range of supplementary tones and the supplementary tone control means decreases the volume level of the supplementary tones in the low-pitched ranges.

7. A supplement control apparatus in accordance with claim 1, wherein the volume level of the supplementary tone is unaffected by the pitch of the melody tone.

8. A melody supplement control apparatus comprising:

melody tone generation means for generating a melody tone having a selectable pitch;

supplemental tone generation means capable of generating a number of supplementary tones each of which has a predetermined relationship with the pitch of the melody tone; and supplemental tone control means coupled to the supplemental tone generation means for controlling the number of supplementary tones generated by the supplemental tone generation means based on the pitch of at least one of the supplementary tones.

9. A melody supplement control apparatus in accordance with claim 8 wherein the supplemental tone generation means generates a range of supplementary tones and the supplementary tone control means decreases the number of supplementary tones in the low-pitched ranges.

10. A melody supplement control apparatus in accordance with claim 8, the supplemental tone control means decreasing the number of supplementary tones as the pitch of at least one of the supplementary tones decreases.

11. A melody supplement control apparatus in accordance with claim 12 wherein the number of supplemental tones decreases as the pitch of the lowest-pitched supplementary tone decreases.

12. A melody supplement control apparatus in accordance with claim 10, wherein said at least one supplementary tone comprises a lowest-pitched supplementary tone.

13. An electronic musical instrument comprising:

means for generating key data representative of a melody tone;

supplementary tone generation means responsive to the key data for generating supplementary tone pitch data;

supplementary tone control means responsive to the supplementary tone pitch data for generating supplementary tone volume level data; and tone generation means responsive to the key data for generating melody tones and responsive to the supplementary tone volume level data for generating supplementary tones which decrease in volume level with decreasing pitch.

14. A melody supplement control method comprising the steps of:

generating a melody tone having a selectable pitch;

generating a supplementary tone having a pitch which has a predetermined relationship with the pitch of the melody tone; and controlling a volume level for the supplementary tone based on the pitch of the supplementary tone.

15. A melody supplement control method in accordance with claim 14, wherein the volume level of the supplementary tone decreases as the pitch of at least one of the supplementary tone decreases.

16. A melody supplement control method in accordance with claim 14, wherein the volume level of the supplementary tone is unaffected by the pitch of the melody tone.

17. A melody supplement control method comprising the steps of:

generating a melody tone having a selectable pitch;

generating a number of supplementary tones each of which has a predetermined relationship with the pitch of the melody tone; and controlling the number of supplementary tones generated based on the pitch of at least one of the supplementary tones.

18. A melody supplement control method in accordance with claim 17, wherein the number of supplementary tones generated decreases as the pitch of at least one of the supplementary tone decreases.

19. A melody supplement control method in accordance with claim 17, wherein the number of supplementary tones generated is controlled based on a lowest-pitched supplementary tone.

20. A melody supplement control method in accordance with claim 19 wherein the number of supplemental tones generated is controlled so as to decrease as the pitch of the lowest-pitched supplementary tone decreases.

21. A method for controlling the generation of supplementary tones in an electronic musical instrument comprising the steps of:

generating key data representative of a melody tone;

generating supplementary tone pitch data;

generating, in response to the generation of supplementary tone pitch data, supplementary tone volume level data; and generating, in response to the key data and the supplementary tone volume level data, supplementary tones which decrease in volume level with decreasing pitch.

* * * * *